United States Patent [19]

Czeiner

[11] 4,177,613

[45] Dec. 11, 1979

[54] UNITIZED ROOF AND CEILING SUBASSEMBLY

[76] Inventor: Joseph A. Czeiner, 2594 West End Rd., West Palm Beach, Fla. 33406

[21] Appl. No.: 460,088

[22] Filed: Apr. 11, 1974

Related U.S. Application Data

[63] Continuation-in-part of Ser. No. 174,060, Aug. 23, 1971, abandoned.

[51] Int. Cl.[2] ..... E04B 1/32

[52] U.S. Cl. ..... 52/86

[58] Field of Search ..... 52/86, 88, 223; 98/40

[56] References Cited

U.S. PATENT DOCUMENTS

| | | | |
|---|---|---|---|
| 2,392,839 | 1/1946 | Davison et al. | 52/223 R |
| 2,415,240 | 2/1947 | Fouhy | 52/88 X |
| 3,064,771 | 11/1962 | Behlen | 52/86 X |
| 3,405,496 | 10/1968 | van der Meer | 52/86 X |

*Primary Examiner*—J. Karl Bell

*Attorney, Agent, or Firm*—Duffield & Lehrer

[57] ABSTRACT

A unitized and prefabricated prestressed roof and ceiling subassembly which employs a first substantially flat sheet of material which serves as the ceiling of the structure and a second relatively flat sheet or layers of sheets of material of width equal to the first sheet of material and of greater length wherein the second sheet or the second layer of sheets of material are bowed into an arc of chord length equal to the first sheet of material and wherein its edges are attached to the edges of the first sheet of material to provide a unitized prestressed roof and ceiling structure. The arch height to span length of the assembly is preferably within the range of from 5 to 10 percent. A plurality of the subassemblies can be joined at their ends and edges to form bays and adjacent bays of a building structure. The subassemblies can include lighting fixtures and ventilation and air conditioning apertures and the individual subassemblies can be partitioned to provide air conditioning, supply and return air ducts in combination with the ceiling and roof decks. Insulation may be permanently attached to the inner surface of the bowed and/or flat member. The bowed member may include enclosed channels which serve as electrical wiring conduits.

7 Claims, 10 Drawing Figures

UNITIZED ROOF AND CEILING SUBASSEMBLY

The present application is a continuation-in-part application of application Ser. No. 174,060, filed Aug. 23, 1971, and now abandoned.

BACKGROUND OF INVENTION

The present invention relates to roof structures and, more specifically, to a unitized and prefabricated prestressed roof and ceiling subassembly in panel form.

Conventional roof structures require that the supporting members be first erected and thereafter the rafters, purlins, trusses and the like be assembled. Finally, the roof superstructure itself is affixed to the roof joists, trusses, etc. Air ducts and lighting fixtures must then be installed in place.

Today, the costs of labor and materials in the building trades are extremely expensive. Any time savings which may be had in assembly at the site as well as in material savings is extremely important.

The building industry has realized these objectives and, today, buildings may be acquired in various stages of prefabrication. Most generally, wall sections can be acquired in prefabricated form and roof trusses may likewise be acquired. Nevertheless, the industry has not progressed to the extent of prefabrication in which an eniter roof-ceiling subassembly may be acquired and simply installed as a panel at the building site without the need of joists, purlins, trusses or other intermediate structural supports. All the more, no such subassembly is available wherein all or portions of the lighting, heating, ventilating and air conditioning equipment and/or appurtenances are additionally included in the subassembly.

OBJECTS AND SUMMARY OF INVENTION

It is an object of the present invention to provide a unitized roof and ceiling subassembly which may be prefabricated at the plant or construction site and merely installed in place at the building site.

It is a further object of the present invention to provide a unitized roof and ceiling subassembly which will further include, as a part of the subassembly, one or more of the requisite ceiling structures such as insulation, lighting, cooling, heating and ventilating components as a part of the subassembly.

The foregoing objects are carried out by the present invention by the use of a first flat sheet member which is of length equal to the supporting members for the proposed building. A second relatively flat sheet member of length in excess of the first sheet member is bowed into a prestressed arc and the ends of the first and second members are connected together to form a prestressed arched roof and ceiling combination. The second sheet member may consist of two or more essentially flat sheets of various cross sections.

Further, in accordance with the present invention, insulation may be permanently attached to the inner surface of either the first or second sheet members. Lighting fixtures and heating, cooling and ventilating equipment and/or accessories may be included in the first member, and, as well, partitions disposed intermediate the first and second sheet members may form return and supply air ducts. The bowed member may be formed of sheets which are longitudinally corrugated or deep drawn to form conduits through which electrical wiring may be pulled.

In building of small size, one unitized roof subassembly may be sufficient to cover the entire roof. In large structures, the subassemblies are joined at their longitudinal edges to form bays and at their ends with additional subassemblies which form adjacent bays.

Other objects and advantages of the present invention will become apparent after the following detailed description of the invention is taken in conjunction with the drawings.

FIGS. *3a–3f* are end cross sectional views of various typical bowed roofing decks which may be employed in the subassemblies.

Figure 4:
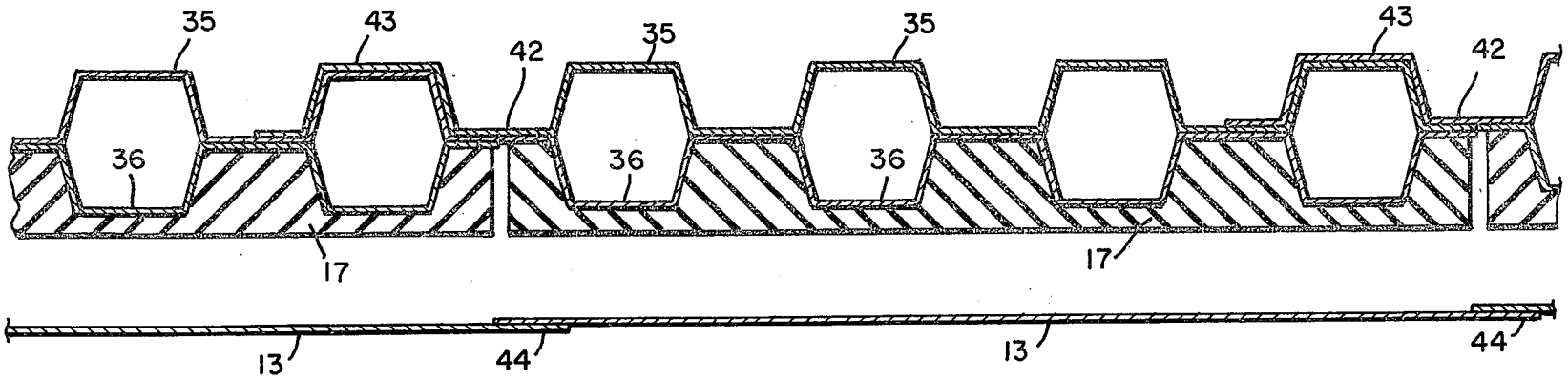

FIG. 4 is an end cross sectional view of two adjacent subassemblies joined one to another; and FIGS. *5a–5b* are side cross sectional views of two subassemblies joined at their ends to form a composite roofing structure.

DETAILED DESCRIPTION OF INVENTION

A. IN GENERAL

Figure 1:
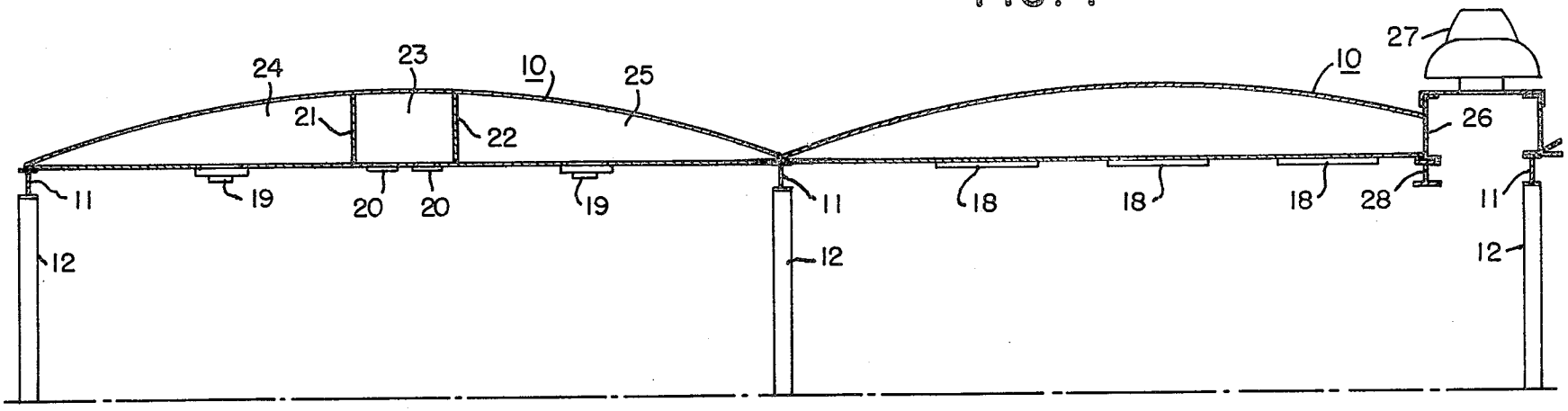
FIG. 1 is a side elevation view of a plurality of unitized subassemblies in accordance with the present invention in place to form a roof structure of a building.

Shown in FIG. 1 is a building structure in which the unitized roof deck and ceiling structure of the present invention is employed. The subassemblies 10 are designed to be supported at either end upon I-beams 11 or other suitable supporting members which are likewise carried by the columns 12 of the building. The solid wall of a building may also serve as the supporting members for the subassemblies.

A plurality of the subassemblies, when connected in side by side relationship, will complete the roof and ceiling structure for a given bay of the building. The adjacent bays are likewise formed by a plurality of side by side subassemblies and the ends of the subassemblies of one bay are joined with the ends of the subassemblies of the adjacent bay to complete a continuous roof deck and ceiling construction.

Figure 2:
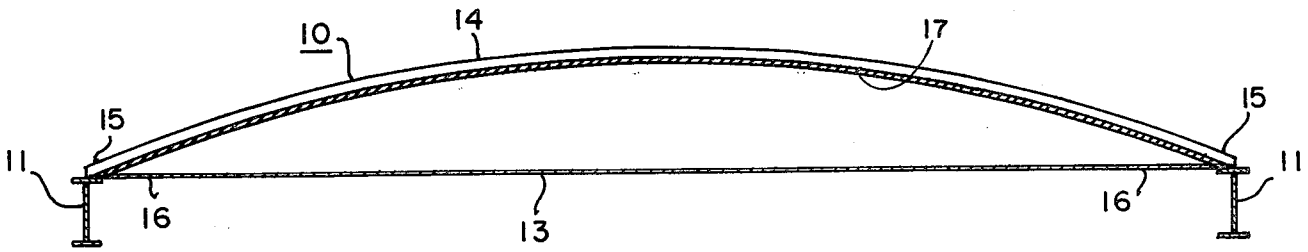
FIG. 2 is a side sectional view of a unitized roof and ceiling subassembly of the present invention.

Turning to FIG. 2, the details of a given subassembly are shown. The subassembly includes a first continuous flat sheet of material 13 which becomes the ceiling of the structure. The roof deck of the subassembly is provided by a second continuous essentially flat sheet of material 14. The second sheet is of width substantially that of the ceiling sheet material 13 but is of length in excess of the ceiling sheet 13. The second sheet 14 is bowed, as shown in FIG. 2, to a point where the chord length of the bow or arc equals the length of the ceiling sheet 13. At this point, the prestressed bow is joined at its ends 15 to the ends 16 of the first sheet. The first sheet 13 is thus in tension and the second sheet 14 is in compression.

The method of joining the ends 16 and 15 of the first and second sheets respectively may be by spot welding, riveting or other suitable arrangements. The ends may also be joined by a curved clip which is secured to the ends 16 and has a recess therein into which the ends 15 of the second sheet are sprung and held by the resilient forces of the second sheet.

The length of each subassembly will be determined by the distance between the supporting members 11 for the particular building involved. Once this has been determined, then the particular length of the second roof sheet 14 and the required bowed height can be calculated as well as the required thickness of material to give the necessary rigidity and strength. In general, the arch is a shallow arch and has a height in the range of from 5 to 10 percent of the span length. A discussion of the equations for determining the required arch sections for different span lengths and height to length ratios for different loads is undertaken following the general discussion of the invention.

The width of the subassembly is a matter of choice. One important factor is that the subassemblies will be fabricated at a plant and shipped to the site of use. Accordingly, the width should be such as to provide for ease of transporting and handling when assembling at the building site.

The resultant subassembly, as shown in FIG. 2, provides a unitized and prefabricated prestressed roof and ceiling subassembly which, together with necessary accessories and/or reinforcements, can be assembled at the factory and merely installed in place on the structure at the building location. The subassembly, when installed, will provide both the ceiling for the building and a rigid prestressed roof deck.

While at the factory, the undersurface of the ceiling sheet 13 may be painted, coated or otherwise finished as required for the building. Additionally, insulation can be added to the subassembly prior to delivery to the site. The insulation could be added to the upper surface of the ceiling sheet 13 or, as shown in FIG. 2, the insulation 17 can be added to the undersurface of the roof deck 14. One suitable form of insulation could be polyurethane or polystyrene sprayed on and bonded to the undersurface of the roof deck 14.

Further, and as a part of the subassembly formed at the plant, can be provisions for recessed light fixtures as shown in FIG. 1 of the drawings. The lighting fixtures 18 may be placed in cutouts in the ceiling structure and the entire light assembly fixed in place prior to the delivery of the ceiling and roof structure. Where continuous rows of lighting fixtures are installed, the first sheet may consist of two longitudinal sheets of adequate thickness; one on either side of the lighting fixtures.

The roof and ceiling subassembly also lends itself to the provision for inclusion of heating and air conditioning components. As shown in FIG. 1, air supply diffusers 19 and air grilles 20 may be incorporated into the ceiling sheet 13. In place of supply air diffusers and return air grilles, perforations may be incorporated in sheet 13 to accomplish the desired air distribution.

The air space formed between the ceiling and roof sheets 13 and 14 respectively may be used as a plenum chamber for conditioned air. For example, where two or more bays of subassemblies are employed, the space between the ceiling and roof sheets of one bay may be used as a supply air plenum and the space between the roof and ceiling sheets of the alternate bay used as the return air plenum or duct. Selection of the bays to be so used will depend upon the air conditioning requirements of the buildings.

It is also possible to use the air space between the ceiling and roof sheets of a given bay as both the supply and return air ducts. As shown in FIG. 1, partitions 21 and 22 disposed advantageously of the air space can form a return air duct 23 while the spaces 24 and 25 on either side of the partitions form the supply air ducts for the building. Inclusion and/or arrangements of partitions will be determined by the air conditioning requirements of the building.

As shown in FIG. 1, the individual subassemblies 10 may be adapted for through the roof ventilation equipment, skylights, heating vents or flues or other structure accessories. The particular equipment of the subassembly involved will incorporate a shortening of one end thereof to accommodate a structural steel roof curb 26. A power roof exhaust fan or other device 27 may then be installed on the roof curb in the usual manner. The roof curb will be supported by structural framing 28 likewise in a conventional manner. It is contemplated that, where large equipment is involved, special width subassemblies corresponding to the width of the equipment may be employed together with a filler panel used to make up the deficiency in width of a standard panel. When smaller sized penetrants such as plumbing vents, conduits, small ducts and the like pierce the roof and ceiling subassembly, a structural steel curb may not be required. In such instances, the penetrant will be suitably flashed into the roof sheet and both the roof and the ceiling sheets will be suitably reinforced to offset the weakening of the sheets caused by piercing.

The cross section of the roof deck 14 may assume different configurations depending on the length of span employed, height to length ratio and the load factor to be applied to the roof. Various cross-sectional configurations which may be employed are shown in FIGS. *3a–3f*. The most simple form of roof decking which can be employed is a sheet of flat cross section. However, it is found that if an undulated, corrugated or other drawn sheet 29 is employed wherein the corrugations run longitudinally of the member, then a greater strength factor is obtained in the prestressed roof deck. Likewise, deep drawn corrugations such as that shown in FIG. *3c* at 30 may be employed.

Where extremely long roof spans or high strength requirements are had, a composite roof decking of two or more sheets may be employed. For example, two corrugated members 31 and 32 may be positioned in back-to-back arrangement so as to form enclosed channels 33. The sheet may be secured together by spot welding, pins, screws or rivets 34 or other suitable means to insure the positioning of the sheet members and their rigidity. As in the case of the single sheet member, deep drawn corrugated sheet members 35 and 36 may be employed and positioned in opposed relationship as shown in FIG. *3f*.

A further form of roof, as shown in FIG. *3e*, may be the combination of deep drawn or corrugated members 37 which are backed on one side by a flat member 38 or on both sides by a flat member 38 and 39. Such an arrangement will give a smooth roof contour and exhibit an extremely high load capacity. It will be appreciated that other combinations of cross sections may be employed within the scope of the invention.

As shown in FIG. *3e*, the roof deck forms which employ enclosed channels present another combination feature for the roof deck and ceiling subassembly. The channels 40 will provide conduits through which electrical wires 41 may be pulled after erection of the subassemblies.

Shown in FIG. 4 are the details of how subassemblies will be joined in side-by-side configuration to form a bay of a building. In the example shown, opposed deep drawn corrugated sheets are used to form the roof deck. The under or bottom sheet 36 will terminate at the normal width of the subassembly at an edge 42. However, the top sheet 35 will extend, on one side only, in a flashing extension 43 for at least one undulation of the corrugated material. The flashing extension 43 will fit over the next adjacent subassembly to form a weatherproof seal. A sealing compound may be placed between the flashing extension and the upper surface of the next adjacent subassembly prior to the subassemblies being joined. Thereafter, the edge of the flashing extension may be spot welded or otherwise attached to the next adjacent subassembly to provide a weatherproof construction.

In a like manner, the ceiling panel or sheet 13 will have an extension flap 44 extending from the opposite side as the flashing extension 43 on the roof sheets. In this manner, the subassemblies may be vertically nested during erection. The extension flap 44 will then be used to connect the ceiling panels of adjacent subassemblies together.

Figure 5A:
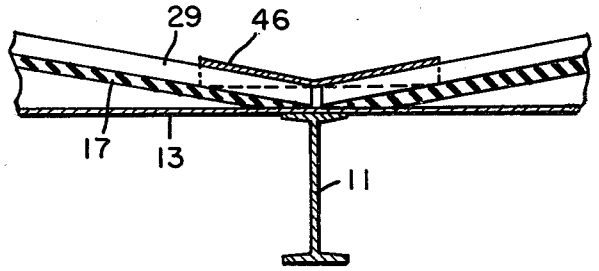
Figure 5B:
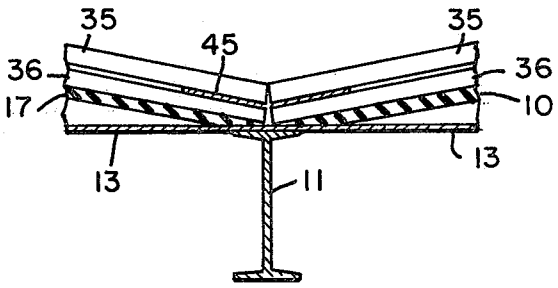

Shown in FIGS. 5a–5b are the details of how the ends of the subassemblies of adjacent bays are connected one to another. Where the roof decking is opposed deep drawn members 35 and 36, as shown in FIG. 4, a V-shaped valley strip 45 may be employed. The valley strip 45 is inserted between the opposed sheets 35 and 36 of both adjacent subassemblies during erection or installation of the subassemblies. Thereafter, the valley strip is spot-welded or otherwise secured to the roof panels to secure the valley strip 45 in place and permanently join the two roof subassemblies together. The openings in the corrugations of the roof sheet may then be further weatherproofed by the use of a suitable sealant.

Where a single flat sheet or single sheet of undulated material is employed as the roof, deck, then a single V-shaped valley strip having edges of correction to generally mate with the roof deck cross section and a smooth center contour may be employed over the edges of the adjacent subassemblies as shown in FIGS. 5a–5b. This valley strip 46 is suitably secured to the edges of the subassemblies. A sealant is used to further weatherproof the seams.

It will be appreciated that the roof and ceiling subassemblies of the present invention provide a unitized and prefabricated assembly which permits the construction of both the roof and ceiling of a structure at a remote location and requires only the erection of the subassemblies at the job site to form a complete roof and ceiling structure. Additionally, such further equipment as lighting, heating, cooling and ventilating accessories and wiring conduit may be incorporated into the unitized subassembly at the factory and/or assembled at the job site.

B. STRUCTURAL ANALYSIS

The discussion following is an analysis of the strength of the prestressed combination roof and ceiling assembly. The analysis was made upon arches of circular, parabolic and elliptical configurations. For all practical purposes, the differences between the strength of the parabolic, circular and elliptical arches vary by less than 2 percent. All of the following calculations and results are based upon parabolic arches.

An important variable involved in the strength of the prestressed roof assembly is height of the arch or height to length ratio. The calculations on the roof assembly were made for shallow arches for ratios of 0.100; 0.075 and 0.050.

The analysis of the roof system was made upon as assumed roof load of 80 lbs. per square foot over the entire roof. The most severe roof loading anticipated in design of such structures is 40 lbs. per square foot resulting from a snow load. In utilizing the design criteria of 80 lbs. per square foot, a factor of safety of 2 is taken.

The analysis of the roof system was further based upon the presumption of an arched member utilizing steel deck of the type employed in reinforced floor slabs in building construction and also roof decks. Decking material of this type is available from such companies as Bowman Building Products, U.S. Steel and other similar suppliers. Such decking material demonstrates a modulus of elasticity $E=29.6\times10^6$ PSI, a tensile strength of $33\times10^3$ PSI and a steel weight of 0.29 lbs/in$^3$. The structural analysis was made using these values.

The types of failure of the roof system which can occur under load are basically three in number. The first type of failure is buckling due to instability. The second type of failure is that due to axial pressures exceeding the tensile strength of the material. Thirdly, failure of the arch may occur by reason of combined axial and bending moments. A brief discussion of each of these types of failures and the formula utilized in the analysis follows.

Considering first failure based upon the criteria of instability of the roof structure, it has been found that two types of instability failure can occur. The first is asymmetrical buckling wherein the arch will collapse on one side downwardly and project upwardly on the other side of the arch. The second form in instability failure is symmetrical snap through wherein the entire arch reverses curvature.

The equation for evaluation of the critical loading pressure upon the arch which results in asymmetrical buckling of the arch is as follows:

$$q_{cr} = \frac{\alpha EI}{L^3}$$

WHERE $q_{cr}$=critical loading pressure
E=modulus of elasticity of arch section
I=moment of inertia of arch section
$\alpha$=closed one half angle of arch in degrees
L=arch span distance.

The second instability failure resulting in symmetrical snap through is determined by the following equations:

$$q_{cr} = \frac{384\ UEIh}{5\ L^4}$$

AND $$U = 1 + \sqrt{\frac{4\,(1-M)^3}{27\,M^2}}$$

$$M = \frac{4I}{Ah^2}$$

WHERE $q_{cr}$; E; I; and L are as above
h=arch height
A=arch cross section area The second type of failure discussed above is that resulting from axial pressures upon the arch exceeding the tensile strength of the material. Such purely axial stresses will result in the arch during uniform loading over the entire arch. The formulas for calculating the stress during such conditions is as follows:

$$N_{max} = \frac{H}{\cos\theta} = \frac{WL}{8h\cos\theta}$$

$$\sigma\ max = \frac{N_{max}}{A}$$

WHERE $N_{max}$=total axial force

H=tension in bottom chord $\theta$=angle of arch to chord at intersection

L=arch span length

W=total load on arch h=arch height

A=arch cross section area $\sigma_{max}$=tensile stress

The third type of failure discussed above is that resulting from combination axial and bending moments upon the arch. Two different conditions may exist in practice which would cause these stresses to develop. The first is where the total load, such as a snow load, will drift entirely over one side of the arch. The second is parabolic ponding wherein the snow load is distributed to each side of the arch in an inverted parabolic configuration.

The equations for determining stress under uniform snow load for ½ span of the arch are as follows:

$$M_{max} = \frac{WL}{32} \qquad H = \frac{WL}{8h}$$

$$N_{max} = \frac{WL\cos\theta}{8h} + \frac{WL\sin\theta}{4}$$

$$\sigma max = \frac{N_{max}}{A} = \frac{M_{max}}{S}$$

WHERE

W, L, $N_{max}$, $\theta$, h, $\rho_{max}$, H and A are as above $M_{max}$=maximum bending moment S=Section modulus The equations for determining stress under parabolic ponding are as follows:

$$N_{max} = \frac{B\sin\theta}{2} + \frac{BL\cos\theta}{14h}$$

$$M_{max} = .012\,BL\ @\ \chi = .12\,L$$

$$\sigma max = \frac{N_{max}}{A} + \frac{M_{max}}{S}$$

WHERE $N_{max}$, $M_{max}$, $\theta$, L, h, A, S and $\sigma_{max}$ are as above B=total load=pL/3 p=62.4h

The ceiling member employed in the combination roof and ceiling assembly is always maintained in tension. Failure by reason are instability resulting in buckling is not present due to the tension. Likewise, bending moments do not occur in the ceiling member. Failure of the ceiling member occurs only by reason of stress exceeding the tensile strength of the material employed. The determination of the stress in the lower member can be made by the following equation:

$$\sigma max = \frac{H}{A}$$

-continued $$H = \frac{WL}{8h}$$

WHERE members of the equations are as above.

Calculations were made of the minimum moment of inertia required for stability of the arched member for spans from 10 to 100 feet and height to length ratios of 5 percent, 7½ percent and 10 percent were made. Additionally, the axial force on the arch and combined axial and bending moments were calculated for spans between 10 and 100 feet for each of the three height to length ratios in loaded situations as uniform load; uniform load distributed over half span and parabolic ponding. Further, stress in the bottom chord was calculated for these conditons. The results of these calculations are too voluminous to include in this discussion but do result in significant conclusions.

One conclusion to be drawn from the analysis is that the stress in the bottom chord or ceiling member is not a critical factor in the design of the arch. These stress levels are sufficiently low to permit the use of relatively thin flat plate members and also permit openings in the ceiling member for ventilators, ducts, etc.

The analysis further demonstrates that the resultant axial compressive component force in the arch under a uniform loading condition is not the critical condition. The critical forces resulting in loading of the arch are the bending moment components.

The loading condition found to be most severe is the vertical uniform load distributed over half span. At span lengths of approximately 100 feet, the parabolic ponding load becomes equally severe. Likewise, the minimum moment of inertia required for stability under uniform load raises very sharply at spans exceeding 90 feet.

Figure 3A:
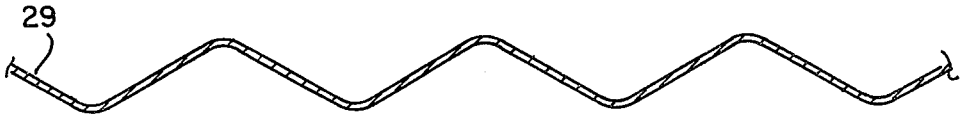
Figure 3B:
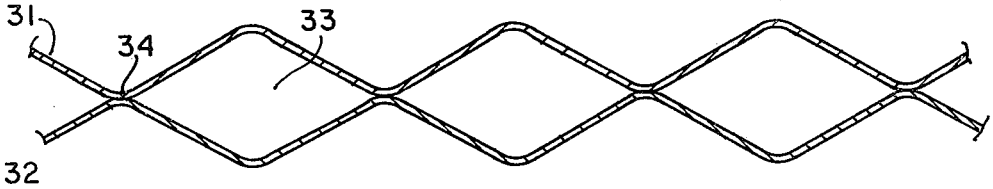
Figure 3C:
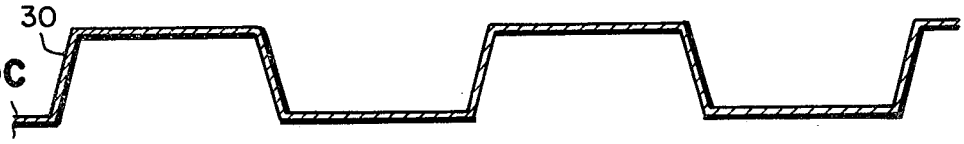
Figure 3D:
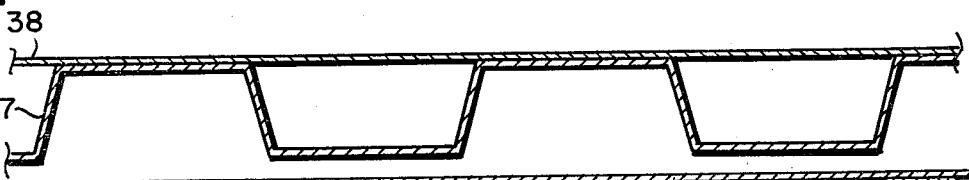
Figure 3E:
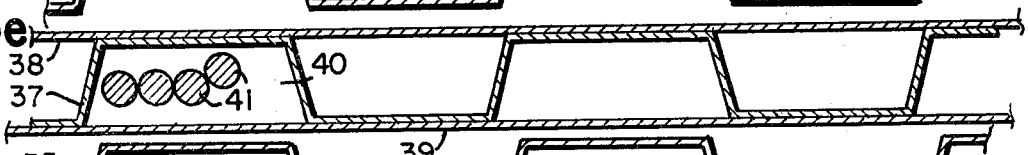
Figure 3F:
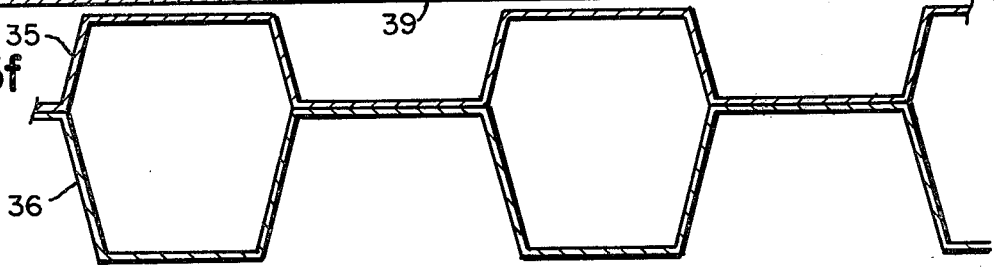

An arch section as illustrated at 30 in FIG. 3c formed of 18 gauge steel will be acceptable for spans up to 50 feet in height to length ratios of from 10 percent down to and including 5 percent. Such a section is available from Bowman Building Products Division of Cyclops Corporation, Pittsburgh, Pa., as illustrated in their catalog sheet number 1J/Bo (1968). The section is formed in 12 inch widths of 18 gauge steel and is 4.5 inches deep. This section has a moment of inertia of 3.088 inches$^4$, a section modulus of 1.130 inches$^3$ and a cross section area of 1.04 inches$^2$.

Spans of between 50 feet and 100 feet may be formed of two sections joined as illustrated at 35–36 in FIG. 3c of the drawings. Two Bowman sections described above so joined will have the required strength for spans of 50 to 100 feet.

The combination roof and ceiling assembly of the present invention has been described in respect to particular sections available. The length of span permissible depends on such factors as the cross sectional area, moment of inertia, tensile strength and loading of the arch all of which will control the maximum length of span and height to length ratio. Accordingly, no limitation as to the scope of the invention is intended by the examples.

I claim:

1. A unitized and prefabricated prestressed combination roof and ceiling assembly adapted to be supported, in situs, between supporting members comprising:

a first relatively thin continuous flat sheet of uniplanar rigid material of a predetermined width and of length at least equal to the spacing between supporting members, a second initially and essentially flat sheet of uniplanar rigid material of width substantially equal to the first sheet and of length in excess of the first sheet and having its longitudinal axis aligned with the longitudinal axis of the first sheet, said second sheet being bowed by pre-stressed compression into a shallow arc of chord length equal to the length of the first sheet, and fastening means innerconnecting together the ends of the first and second sheets to form a prefabricated and unitized assembly and to maintain the second sheet in compression forming an arched and prestressed roof deck and the first sheet in tension forming the ceiling of a structure when the assembly is in position between the supporting members.

2. The roof and ceiling assembly of claim 1 wherein the shallow arch is of a height to chord length ratio in the range of from 10 to 5 percent.

3. The roof and ceiling assembly of claim 2 wherein the second sheet is formed of a thin metallic material and includes longitudinally extending undulations therein increasing the moment of inertia of the sheet.

4. The roof and ceiling assembly of claim 3 formed of approximately 18 gauge material, a chord length not exceeding 50 feet and a moment of inertia not exceeding 4 inches 4 for a 1 foot cross section.

5. The assembly of claim 1 wherein a suitable insulation material is applied to the underside of the second sheet.

6. The assembly of claim 1 wherein the second sheet is formed of two sheets overlaying each other and wherein at least one of the sheets includes undulations therein having a longitudinal axis equal to the length of the sheet and wherein the two sheets are disposed to form enclosed channels which may act as continuous conduits, ducts or raceways for electrical wires.

7. A composite roof structure formed of a plurality of unitized roof and ceiling sub-assemblies according to claim 1, said sub-assemblies being joined at the longitudinal edges of the first and second sheets of each subassembly, between a common supporting member, to form bays of a building and joined at their ends with subassemblies carried by adjacent supporting members to form adjacent bays of the structure.

* * * * *